United States Patent [19]

Suga et al.

[11] 4,010,036

[45] Mar. 1, 1977

[54] LITH-TYPE SILVER HALIDE PHOTOSENSITIVE MATERIAL CONTAINING A P-BENZOQUINONE DERIVATIVE

[75] Inventors: Tsuneo Suga; Ken-ichi Kishi; Shinobu Korematsu; Masaru Kanbe; Toshiaki Takahashi, all of Hino, Japan

[73] Assignee: Konishiroku Photo Industry Co., Ltd., Tokyo, Japan

[22] Filed: May 22, 1975

[21] Appl. No.: 579,792

Related U.S. Application Data

[63] Continuation-in-part of Ser. No. 371,853, June 20, 1973, abandoned.

[30] Foreign Application Priority Data

June 30, 1972 Japan ..... 47-64957

[52] U.S. Cl. ..... 96/66.3; 96/66 R; 96/107; 96/109; 96/95

[51] Int. Cl.[2] ..... G03C 1/06; G03C 1/28; G03C 5/30

[58] Field of Search ..... 96/66 R, 107, 95, 109, 96/66.3

[56] References Cited

UNITED STATES PATENTS

| | | | |
|---|---|---|---|
| 2,751,295 | 6/1956 | Salminen et al. | 96/95 |
| 3,396,022 | 8/1968 | Dersch | 96/109 |
| 3,420,667 | 1/1969 | Copeland | 96/107 |
| 3,519,428 | 7/1970 | Ishikawa et al. | 96/95 |
| 3,615,517 | 10/1971 | Milton | 96/107 |
| 3,708,303 | 1/1973 | Salesin | 96/107 |

*Primary Examiner*—Won H. Louie, Jr.
*Attorney, Agent, or Firm*—Bierman & Bierman

[57] ABSTRACT

An improved silver halide photosensitive material of the lith-type is disclosed which is suitable for an infectious development in order to obtain high contrast images with high sensitivity. A method for developing the material is also disclosed. The material comprises silver halide grains containing at least 50 mole per cent of silver chloride, less than 40 mole per cent of silver bromide and less than 5 mole percent of silver iodide based on total silver halide, the average size of the grains being 0.05 to 0.5 microns in diameter. The material further comprises a compound represented by the following general formula I or II

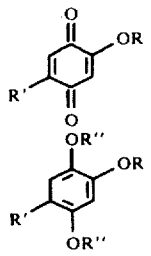

I

II wherein R is alkyl, aryl, aralkyl or acyl; R′ is hydrogen or —OR; and R′′ is hydrogen or acyl.

4 Claims, No Drawings

LITH-TYPE SILVER HALIDE PHOTOSENSITIVE MATERIAL CONTAINING A P-BENZOQUINONE DERIVATIVE

This application is a continuation-in-part of Ser. No. 371,853, filed June 20, 1973, now abandoned.

invention relates to a silver halide photosensitive material. More particularly, the invention relates to a lith-type silver halide photosensitive material (hereinafter referred to as "lith-type photosensitive material") by which is meant a photosensitive material for halftone engraving or line engraving to be used in the lithographic industry. In use, it is required to impart a high contrast.

Accordingly, a high contrast developer called an infectious developer is used to allow the lith-type photosensitive material to obtain high contrast. As is well-known in the art, the infectious developer contains a chemical compound such as hydroquinone and/or its derivatives and is characterized by a very low sulfite ion concentration. As the hydroquinone derivatives such compounds as chlorohydroquinone, bromohydroquinone, 2,3-dichlorohydroquinone, 2,5-dimethylhydroquinone, 2,3-dibromohydroquinone, 1,4-dihydroxy-2-acetophenone-2,5-dimethylhydroquinone, 2,5-diethylhydroquinone, 2,5-di-p-phenethylhydroquinone, 2,5 dibenzoylaminohydroquinone, 2;5-diacetaminohydroquinone, etc. and esters thereof such as formates and acetates are well known. The sulfite salts practically employed are sodium sulfite, potassium sulfite, ammonium sulfite, etc. It is considered that oxides of hydroquinone formed during the development, such as semiquinone and quinone accelerate the advance of the development so as to form a high contrast image. The infectious developer usually also contains formaldehyde and is detailed in J. A. C. Yule (phonetic), "Formaldehyde Hydroquinone Developer and Infectious Development" in Journal of the Franklin Institute, vol. 239, page 221 (1945).

In case the lith-type photosensitive material is developed with use of an infectious developer, a high contrast is obtained as compared with the case where the development is conducted with use of an ordinary metol-hydroquinone developer (PQ developer), but the sensitivity is lowered. This is a defect of the lith-type photosensitive material.

Various sensitizing methods have been employed to increase the sensitivity of the lith-type photosensitive material. For instance, sensitizing methods applied on usual silver halide photosensitive materials, such as gold-sensitization, sulfur-sensitization, reduction-sensitization and optical sensitization, are adopted for improving the sensitivity of the lith-type photosensitive material. However, it is difficult to obtain a high sensitizing effect by such methods, and further, the high contrast tends to be lost as the sensitivity is increased. Therefore, these methods are not suitable for sensitization of the lith-type photosensitive material.

It is tentatively possible to sensitize the silver halide photosensitive material while attaining a high contrast by adding p-benzoquinone to a silver halide emulsion. However, the resulting sensitization is insufficient and stable photographic characteristics cannot be obtained because of instability of p-benzoquinone. Accordingly, this method is of no practical utility. It is a primary object of this invention to provide a lith-type photosensitive material which can overcome the foregoing defects of the conventional techniques and can be greatly sensitized, not only without loss of high contrast in the development by an infectious developer, but with an increase in the contrast, and which can exhibit stable photographic characteristics.

As a result of the systematic research on p-benzoquinone derivatives, it has been found that the above object can be attained when a p-benzoquinone derivative expressed by the following general formula [1] or a precursor thereof is incorporated into the lith-type photosensitive material:

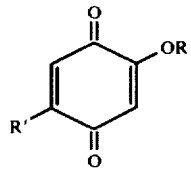

[1]

in which R is an alkyl, aryl, aralkyl or acyl group, and R' is a hydrogen atom or a group —OR. p-benzoquinone derivatives expressed by the above general formula [1] are very stable compounds which can be easily synthesized. In the above general formula [1], alkyl, aryl, aralkyl and acyl groups as R may have suitable substituents such as alkoxy groups and the like, Preferred alkyl groups are those having 1 to 12 carbon atoms, and they may be substituted by an alkoxy group such as methoxy and ethoxy groups.

As the aryl group there may be mentioned, for instance, anphenyl group and the like, and as the aralkyl group there may be exemplified a benzyl group and the like. The acyl group includes a benzoyl group and the like. Among the above P-benzoquinone derivatives of the general formula [1], those in which R is an alkyl or acyl group and R' is a group-OR are detailed in "Berichte der Deutschen Chemischen Gesellschaft, vol. 34, page 3993(1901)" and "Journal of the American Chemical Society, vol. 78, page 1235(1956)". Componds of the general formula [1] in which R is an aryl group and R' is a group—OR are detailedly disclosed in "Monatshefte Fur chemie (phonetic), vol. 48, page 208", and those in which R is an alkyl group and R' is a hydrogen atom are detailedly disclosed in "Berichte der Deutchen Chemischen Gesellschaft, vol. 21, page 605 (1888), vol. 22, page 2381 (1889) and vol. 35, page 4194 (1902)."

More specifically compounds expressed by the general formula [1] in which R' is a hydrogen atom, namely mono-substituted 1,4-benzoquinones, can be synthesized by oxidation of o-alkoxyanilines and the like, and 2,5-disubstituted 1,4-benzoquinones can be obtained by condensation of p-benzoquinone with an alcohol in the presence of zinc chloride or condensation of 2,5-dihydroxy-1, 4-benzoquinone with an alcohol in the presence of boron trifluoride etherate. Further, di-substituted 1,4-benzoquinones in which R is an acyl group and R' is a group —OR can readily be synthesized by acylation of 2,5-dihydroxy-1,4-benzoquinone with an alcohol in the presence of boron trifluoride etherate. Further, di-substituted 1,4-benzoquinones in which R is an acyl group and R' is a group —OR can readily be synthesized by acylation of 2,5-dihydroxy-1,4-benzoquinone.

Precursors of p-benzoquinone derivatives of the general formula [1] are compounds which can yield or release p-benzoquinone derivatives of the general formula [1] at an optional stage in the lith-type photosensitive material.

For instance, it is well known that hydroquinone derivatives are readily oxidized to quinone derivatives, and hydroquinones which are substituted at the 2- and 5-positions by electron donative groups such as alkoxy groups are very likely to be converted to quinone derivatives not only in the solution state but also in the solid state.

This tendency is conspicuous in the presence of an alkaline substance such as a liquid developer. It is also known that compounds in which a phenolic hydroxyl group is acylate are readily converted to original phenol forms instaneously in an alkaline aqueous solution or gradually in water.

Accordingly, when such compounds are incorporated in advance in a lith-type photosensitive material, p-benzoquinone compounds can be formed by air oxidation or by an action of a developer, and such photosensitive material can exhibit an effect equivalent to the attained by a lith-type photosensitive material incorporated with the p-benzoquinone derivative.

Preferred precursors of the benzoquinone derivative of the general formula [1] which are used in this invention are expressed by the following general formula II:

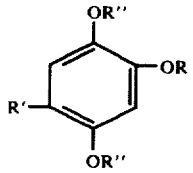

Wherein R and R' are as defined above, and R'' is a hydrogen atom or acyl group.

When such precursor is incorporated in a lith-type photosensitive material, it easily yields a p-benzoquinone derivative of the general formula [1] during storage of the photosensitive material or during the development treatment, and there is obtained an effect equivalent to that obtained in the case of a photosensitive material incorporated with the p-benzoquinone derivative of the general formula [1].

Among precursors represented by the general formula [II], those in which R'' is a hydrogen atom can be easily synthesized by reduction of a p-benzoquinone derivative of the general formula [I], and those in which R'' is an acyl group can be easily synthesized by acylating a corresponding hydroquinone or reductively acylating a benzoquinone derivative of the general formula [1]. Details of these synthesis methods are illustrated in "Berichte der Deutschen Chemischen Gesellschaft, vol. 34, page 3999 (1901)". and "Journal of the American Chemical Society, vol. 78, page 1233 (1956)."

Typical instances of p-benzoquinone derivatives and their precursors to be used in this invention will now be illustrated by reference to Synthesis Examples, but compounds to be used in this invention are not limited to these specific compounds.

SYNTHESIS EXAMPLE 1

This Example illustrates the synthesis of 2,5-dipropoxy-1,4-benzoquinone.

5 g of p-benzoquinone was mixed with 24 g of n-propanol and 6 g of zinc chloride, and the mixture was refluxed for 1 hour. The reaction mixture was naturally cooled and precipitated crystals were recovered by filtration.

Recrystallization from ethanol gave 2.0 g of a yellow flake melting at 186° to 188° C. Results of the elementary analysis are as follows:

Calculated: C=64.28%, H=7.14 %. Found: C= 64.48 %, H =7.39 %.

SYNTHESIS EXAMPLE 2

This Example illustrates the synthesis of 2,5-dibenzoyloxy -1,4-benzoquinone.

2 g of 2,5-dihydroxy-1,4-benzoquinone was heated and dissolved in 2.5 g of benzoyl chloride, and the solution was cooled with ice to obtain 3.5 g of a yellow flake.

Recrystallization from glacial acetic acid gave 2.8 g of a yellow needle melting at 174° C.

Results of the elementary analysis are as follows:

Calculated : C=68.96 %, H =3.44%. Found : C= 69.01 %, H =3.64 %.

SYNTHESIS EXAMPLE 3

This example illustrate the synthesis of 2,5-di(2methoxyethoxy)-1,4-benzoquinone.

10.8 g of P-benzoquinone, 12.5 g of zinc chloride and 50 ml of methyl cellosolve (ethylene glycol monomethyl ether) were heated and agitated on an oil bath maintained at 110° to 120° C.

Methyl cellosolve was distilled off under reduced pressure, and the residue was extracted with ether.

Ether was distilled off and the resulting brown substance was recrystallized from an alcohol to obtain 3.3 g of a yellowish brown needle melting at 67° to 70° C.

Results of the elementary analysis are as follows:

calculated: C=56.12%, H=6.31%. Found : C=56.40%, H=6.41%.

SYNTHESIS EXAMPLE 4

This Example illustrates the synthesis of 2,5-dimethoxyhydroquinone diacetate. 1.7 g of 2,5-dimethoxy-1,4-benzoquinone was dissolved under heat in 50ml of anhydrous acetic acid, and 1.99 g of zinc powder was added to the solution. 5 ml of triethyl was added to the mixture and it was agitated under heat for 45 minutes on an oil bath maintained at 90° to 100° C. Then, the reaction mixture was filtered while it was still hot, and the filtrate was cooled to obtain a colorless crystal. Recrystallization from anhydrous acetic acid gave 1.4 g of a colorless needle melting at 186° to 187° C.

Results of the elementary analysis are as follows:

Calculated : C =56.69%, H =5.67%. Found : C=56.83%, H=5.98%.

As other typical instances of p-benzoquinone derivatives or precursor thereof than the above there may be 2-ethoxy-1,4-benzoquinone; 2,5-dihydroxy-1,4-benzoquinone; 2,5-didecoxy-1,4-benzoquinone and 2,5-diethoxyhydroquinone. When a P-benzoquinone derivative or a precursor thereof synthesized according to a method such as described above is incorporated in a lith-type photosensitive material, the amount added is not particularly crytical, but it is preferred that such compound is incorporated in an amount of 10 mg to 10 g per mole of the silver halide. The addition may be effected at the time of formation of a silver halide emulsion, at the time of aging the silver halide emulsion or before coating of the silver halide emulsion, but it is preferred that the addition is conducted at the time of aging or before coating. In general, the p-benzoquinone derivative or its precursor is added in the form of a solution prepared with use of water or a suitable organic solvent such as methanol.

When such compound is incorporated in a lith-type photosensitive material, it may be added to any layers constituting the lith-type photosensitive material, namely emulsion layer, protective layer, intermediate layer and the like. It is possible to incorporate the compound into two or more layers. Further, two or more of compounds of the formula [1] or precursors thereof may be used in combination.

A silver halide emulsion to be used in this invention is a lith-type photosensitive emulsion comprising silver halide grains containing at lease 50 mole percent of silver chloride, less than 40 mole percent of silver bromide and less than 5 mole percent of silver iodide based on total silver halide. The size of the grains is preferably 0.05 to 0.5 microns in average diameter. As the binder, there may be employed gelatin derivatives and synthetic polymers such as polyvinyl alcohol. The emulsion may be sensitized sulfur, gold polythyleneazide sensitizer, or optically sensitized with sensitizing dye according to a customary method, and it may comprise various photographic additives for a lith-type photosensitive material such as a film-hardener necessary for maintaining the film strength and a surface active agent acting as a coating assistant.

The lith-type photosensitive material of this invention formed by above procedures exhibits a highly improved sensitivity at the lithographic development and gives an excellent high contrast. Further, it has stable photographic characteristics. These are merits of the lith-type photosensitive material of this invention. This invention will now be illustrated more detailedly by reference to an Example, but the embodiment of this invention is not limited by this Example.

EXAMPLE

A silver chlorobromide emulsion containing 30 mole % of silver bromide and having an average particle size of 0.3 u was prepared, and sodium thiosulfate was added thereto in an amount of $5 \times 10^{-8}$ mole per mole of the silver halide. The emulsion was aged at 60° C. for 50 minutes, and a compound shown in Table given below and 30 mg of polyethylene glycol M. W. (4000) were added thereto. The emulsion was coated and dried on a polyethylene terephthalate film base and a protective layer was formed thereon.

So formed samples and samples formed by incorporating a compound shown in Table given below not into the emulsion layer but in the protective layer were tested to obtain results of sensitmetric properties shown in the Table.

The development was conducted on samples light-exposed with use of a step tablet by employing a developer of the following recipe:

| Recipe of Liquid Developer (1 liter) | |
|---|---|
| Formaldehyde sodium bisulfite | 60 g |
| hydroquinone | 18 g |
| sodium carbonate | 70 g |
| potassium bromide | 3 g |
| Boric acid | 8 g |
| water to make | 1 liter |

Table

| Additive Compound | Amount Added, g per mole of silver halide | Development Time 2 minutes relative speed | 2 minutes gamma value | 3 minutes relative speed | 3 minutes gamma value |
|---|---|---|---|---|---|
| blank | | 100 | 8 | 180 | 9 |
| 2-Ethoxy-1,4-Benzoquinone | 0.3 | 200 | 9 | 300 | 10 |
| Compound of the Synthesis of Example 1 | 0.5 | 250 | 9 | 400 | 10 |
| 2,5-Dihydroxy-1,4-Benzoquinone | 0.1 | 150 | 8 | 300 | 9 |
| Compound of the Synthesis of Example 3 | 0.2 | 220 | 9 | 350 | 11 |
| Compound of the Synthesis of Example 4 | 0.4 | 270 | 8 | 400 | 9 |
| 2-Ethoxy-1,4-Benzoquinone* | | 140 | 8 | 220 | 10 |

*1 g of 2 - Ethoxy - 1,4 - Benzoquinone was added to 1 liter of a protective layer-forming solution containing 20 g of gelatin As is apparent from the results shown in the above Table, when a p-benzoquinone derivative of the general formula (1) or a precursor thereof is incorporated in a lith-type photosensitive material, a high gamma value can be obtained and the sensitivity can be greatly heightened.

In samples according to this invention shown in the Example, there was hardly observed any change in photographic characteristics even with the lapse of time.

What is claimed is:

1. A lith-type silver halide photosensitive material comprising high contrast silver halide grains containing at least 50 mole per cent of silver chloride, less than 40 mole percent of silver bromide and less than 5 mole per cent of silver iodide based on total silver halide, the size of said grains being 0.05 to 0.5 microns in average diameter, said material further comprising, in an amount of 10 mg to 10g per mole of silver halide, a compound represented by the following general formula I or II:

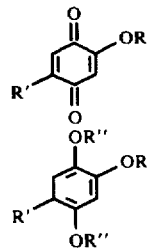

I II wherein R is alkyl, aryl, aralkyl or acyl; R' is hydrogen or —OR; and R'' is hydrogen or acyl.

2. A lith-type silver halide photosensitive material of claim 1 wherein R is lower alkyl.

3. A lith-type silver halide photosensitive material of claim 1 wherein said compound is represented by the following general formula III or IV

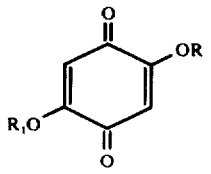

III

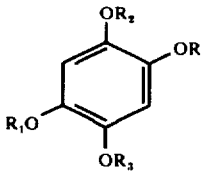

IV wherein R is as defined in claim 1; $R_1$ is alkyl, aryl, aralkyl or acyl; and $R_2$ and $R_3$ are individually acyl.

4. In a method for developing a lith-type silver halide comprising high contrast silver halide grains containing at least 50 per cent of silver chloride, less than 40 mole per cent of silver bromide, and less than 5 mole per cent of silver iodide based on total silver halide, the average size of said grains being 0.05 to 0.5 microns in diameter, said method comprising developing said photosensitive material by the use of an infectious developer which comprises a developing agent consisting essentially of a hydroquinone compound and a very low concentration of sulfite ion, the improvement which comprises said photosensitive material comprising, in an amount of 10 mg to 10g per mole of silver halide, a compound represented by the following general formula I or II:

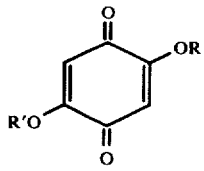

I

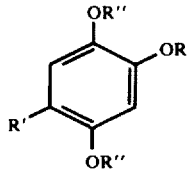

II wherein R is alkyl, aryl, aralkyl or acyl; R′ is hydrogen or —OR and R″ is hydrogen or acyl.

* * * * *